US007214123B2

(12) United States Patent
Han

(10) Patent No.: US 7,214,123 B2
(45) Date of Patent: May 8, 2007

(54) RETAINER RING, POLISHING HEAD, AND CHEMICAL MECHANICAL POLISHING APPARATUS

(75) Inventor: Ja-hyung Han, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 11/513,122

(22) Filed: Aug. 31, 2006

(65) Prior Publication Data

US 2007/0049170 A1 Mar. 1, 2007

(30) Foreign Application Priority Data

Aug. 31, 2005 (KR) ..... 10-2005-0080923

(51) Int. Cl.
*B24B 49/00* (2006.01)

(52) U.S. Cl. ..... 451/7; 451/53; 451/6; 451/41; 451/285

(58) Field of Classification Search ..... 451/5–7, 451/41, 53, 285–290
See application file for complete search history.

(56) References Cited

U.S. PATENT DOCUMENTS 5,605,488 A * 2/1997 Ohashi et al. ..... 451/7
6,464,561 B2 * 10/2002 Sandhu et al. ..... 451/5
6,638,141 B2 * 10/2003 Ide ..... 451/7
6,686,284 B2 2/2004 Chung et al.

FOREIGN PATENT DOCUMENTS

JP 2004-249452 9/2004
KR 10-2005-0033736 4/2005

* cited by examiner

*Primary Examiner*—Lee D. Wilson
*Assistant Examiner*—Anthony Ojini
(74) *Attorney, Agent, or Firm*—Harness, Dickey & Pierce, P.L.C.

(57) ABSTRACT

A retainer ring configured to reduce heat generated during a polishing process may include a heat absorbing element, a thermoelectric element, and a heat dissipating element. A polishing head configured to polish a wafer may include a wafer carrier, a retainer ring, and a cooling element. A chemical mechanical polishing apparatus including a polishing pad formed on a platen and a polishing head including a retainer ring.

26 Claims, 13 Drawing Sheets

RETAINER RING, POLISHING HEAD, AND CHEMICAL MECHANICAL POLISHING APPARATUS

PRIORITY STATEMENT

This application claims priority from Korean Patent Application No. 10-2005-0080923 filed on Aug. 31, 2005 in the Korean Intellectual Property Office, the disclosure of which is incorporated herein by reference in its entirety.

BACKGROUND

1. Field

Example embodiments relate to a retainer ring, a polishing head, and a chemical mechanical polishing apparatus. For example, example embodiments relate to a retainer ring having a thermoelectric element and a polishing head and a chemical mechanical polishing apparatus, having the retainer ring.

2. Description of the Conventional Art

Chemical mechanical polishing (CMP) is a semiconductor manufacturing processes that may use a CMP apparatus having a polishing pad to polish a wafer. A chemical solution including a slurry may be used in a manner such that a chemical reaction is induced on a wafer, and mechanical force produced by the polishing pad may be transmitted to the wafer so as to planarize the surface of the wafer.

A CMP apparatus may include a platen, a polishing pad, and/or a polishing head, which may be composed of a retainer ring and a wafer carrier. When polishing the wafer surface by rotating the polishing head, the temperature may rise due to friction between the polishing pad and the retainer ring, friction between the retainer ring and the wafer, and/or friction between the wafer and the polishing pad. The increase in temperature may lower the yield of the CMP process. For example, erosion and dishing may occur to a greater extent at the edge of the wafer than at the center of the wafer. Erosion is a phenomenon in which a portion of a spacer on a relatively fine pattern is concavely removed during the polishing process. Dishing is a phenomenon in which a top portion of a layer deposited in a trench becomes concave, like a dish, during the polishing process.

In the conventional art, a cooling device may be arranged in a platen to lower the heat during a CMP process. However, because the polishing pad is formed of polyurethane having a low thermal conductivity, it may be difficult to effectively reduce the heat.

SUMMARY

Example embodiments of may permit temperatures of a polishing pad, an edge of a wafer, and slurry to be reduced, may prevent/reduce erosion and/or dishing of an edge portion of the wafer, and may prevent/reduce a non-uniform surface polishing rate.

In an example embodiment, a retainer ring may include a heat absorbing element configured to surround a wafer therein, a thermoelectric element disposed in the heat absorbing element, and a heat dissipating element disposed on the thermoelectric element to dissipate heat absorbed by the heat absorbing element.

In another example embodiment, a polishing head may include a wafer carrier configured to hold and position a wafer, a retainer ring configured to reduce heat during a polishing process, and a cooling element disposed over the retainer ring and configured to dissipate the heat.

In another example embodiment, a chemical mechanical polishing apparatus may include a retainer ring and/or a polishing head.

BRIEF DESCRIPTION OF THE DRAWINGS

Example embodiments of the present invention may be more clearly understood from the following detailed description when taken in conjunction with the accompanying drawings, in which.

DETAILED DESCRIPTION OF EXAMPLE EMBODIMENTS

Figure 1A:
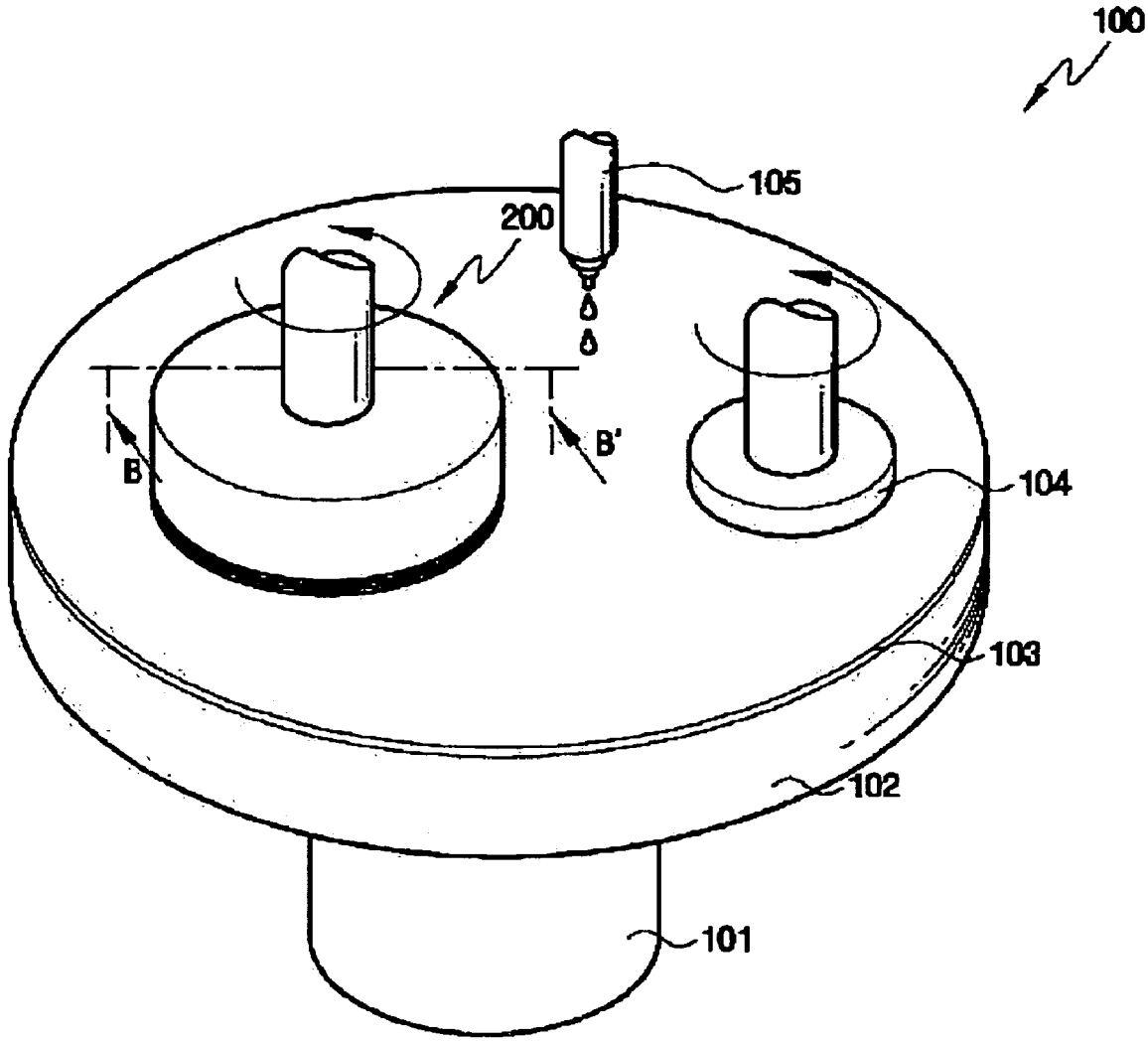
FIG. 1A is a perspective view illustrating a chemical mechanical polishing apparatus in accordance with an example embodiment.

Reference will now be made in greater detail to example embodiments, examples of which are illustrated in the accompanying drawings. Wherever possible, the same reference numerals will be used throughout the drawings and the description to refer to the same or like elements.

It will be understood that when an element or layer is referred to as being "on", "connected to" or "coupled to" another element or layer, it may be directly on, connected or coupled to the other element or layer or intervening elements or layers may be present. In contrast, when an element is referred to as being "directly on," "directly connected to" or "directly coupled to" another element or layer, there may be no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms may be only used to distinguish one element, component, region, layer or section from another region, layer or section. Thus, a first element, component, region, layer or section discussed below could be termed a second element, component, region, layer or section without departing from the teachings.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting global. As used herein, the singular forms "a", "an" and "the" may be intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-section illustrations that may be schematic illustrations of idealized embodiments (and intermediate structures) of the present invention. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1B:
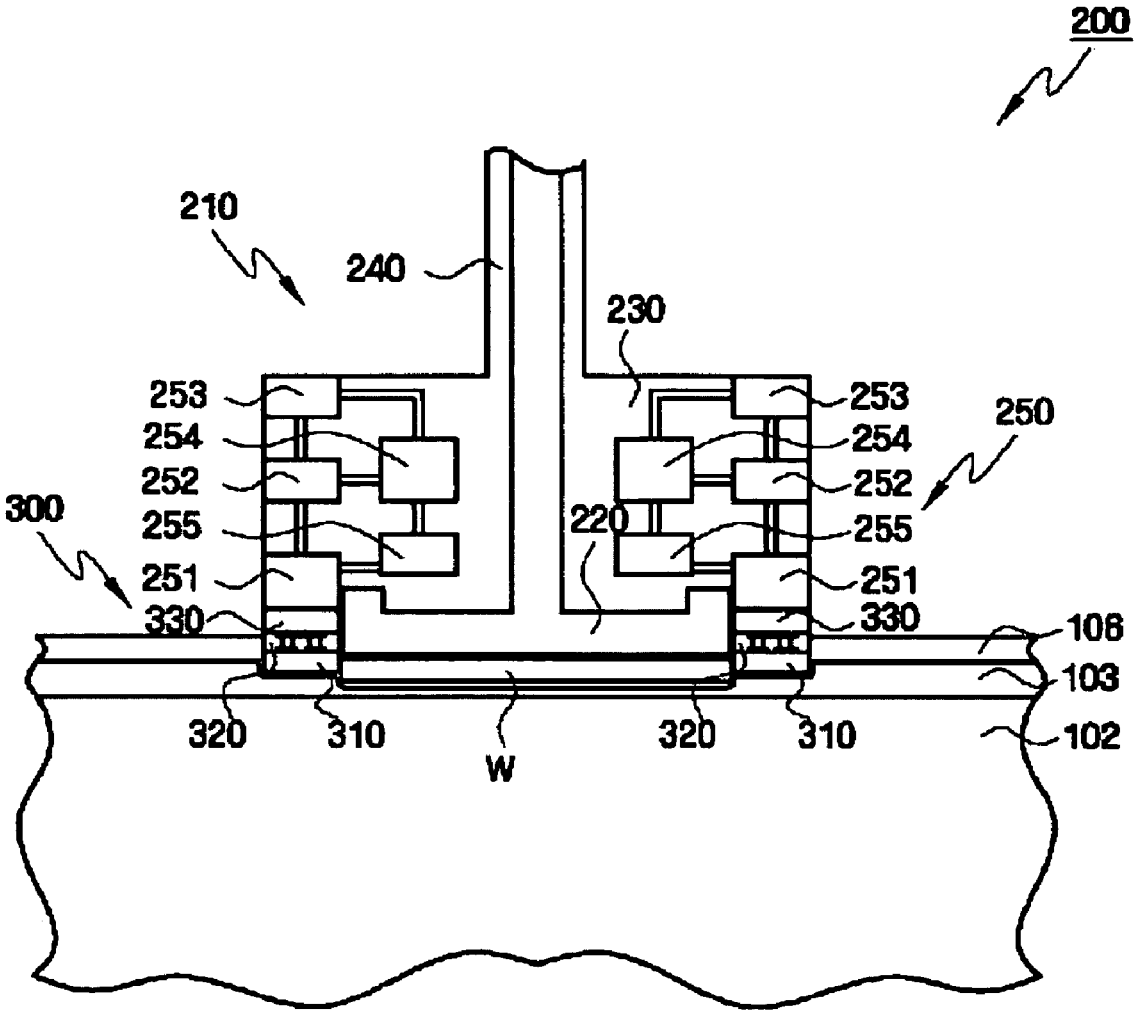
FIG. 1B is an example of longitudinal cross-sectional view taken along the line B–B' of FIG. 1A.

FIG. 1A is a perspective view illustrating a chemical mechanical polishing apparatus in accordance with an example embodiment, and FIG. 1B is a longitudinal cross-sectional view taken along the line B–B' of FIG. 1A.

Referring to FIGS. 1A and 1B, the chemical mechanical polishing apparatus 100 in accordance with an example embodiment may include a platen rotation shaft 101, a platen 102, a polishing pad 103, a pad conditioner 104, a slurry dispensing device 105, and/or a polishing head 200. The polishing head 200 may include a retainer ring 300 and/or a wafer carrier 210.

The platen 102 may rotate the polishing pad 103 at a desired speed in order to polish a wafer W. The platen 102 may be positioned underneath the polishing pad 103. The platen 102 may be connected to a platen driving motor (not shown) through the platen rotation shaft 101. The platen 102 may be formed of an aluminum plate or a stainless steel plate. The platen 102 may have a disc shape, and may be rotated at various speeds. Through the rotation of the platen 102 at various speeds, it may be possible to precisely polish the wafer W.

The polishing pad 103 may be rotated to polish the wafer W in cooperation with abrasive particles formed thereon. The polishing pad 103 may be made of polyurethane, which may be formed with fine protuberances, for example, a kind of elastomeric material having a rough surface. The polishing pad 103 may be positioned on the platen 102. The polishing pad 103 may also be rotated by the platen 102.

The pad conditioner 104 may be provided to reduce the abrasion of the polishing pad 103. After a period of use, the protuberances on the polishing pad 103 may be worn by friction between the polishing pad 103 and the wafer W. The wear to the protuberances may make it difficult to appropriately polish the wafer W. The pad conditioner 104 may be used with the polishing pad 103, so that the polishing pad 103 may be used for an extended time without being replaced.

The slurry dispensing device 105 may dispense slurry solution 106 onto the polishing pad 103. The slurry solution 106 may be used to conduct the chemical polishing process. The slurry solution 106 may be used to chemically planarize the wafer W. Abrasive particles contained in the slurry solution 106 may polish the wafer W as the polishing pad 103 is rotated. The abrasive particles may be formed of fine grains to reduce scratches on the surface of the wafer W.

The polishing head 200 may include the wafer carrier 210 and the retainer ring 300. The polishing head 200 may polish the wafer W when the wafer W is fastened to the lower surface of the polishing head 200. The polishing head 200 may be positioned to face the platen 102. To rotate the wafer W, a motor may be mounted inside or outside the polishing head 200. In addition to rotating, the polishing head 200 may move in the x, y, and z axes. Accordingly, the wafer may be polished.

The wafer carrier 210 may hold the wafer W, and also position the wafer W above the polishing pad 103. The wafer carrier 210 may include wafer suction 220, a head body 230, a head rotation shaft 240, and/or cooling global element 250.

The vacuum suction element 220 may hold the wafer W with vacuum. A thin film (not shown), for example, a membrane, may be applied to the lower end of the wafer suction 220. The membrane may be brought into contact with the surface side not to be polished on the wafer W. In other words, a first surface side to be polished on the wafer W may be positioned to face the polishing pad 103, and a second surface side to be polished on the wafer W may be brought into contact with the wafer carrier 210.

The head body 230 may support the vacuum suction element 220, the head rotation shaft 240, and the cooling element 250.

The cooling element 250 may cool the heat dissipating element 330 of the retainer ring 300. The cooling element 250 may be a water cooling-type cooling device. By placing the cooling element 250 in the polishing head 200, it may be possible to manufacture the retainer ring 300 to be compact in size.

The water cooling-type cooling device may include a water jacket 251, a temperature adjustor 252, a radiator 253, a water tank 254, and a water pump 255. The water jacket 251 may be positioned to be connected with the heat dissipating element 330 of the retainer ring 300 to reduce the heat of the heat dissipating element 330.

The retainer ring 300 may prevent the wafer W from being unintentionally released from the wafer carrier 210 during the polishing process. The retainer ring 300 may be positioned below the wafer carrier 210 to surround the side surface of the wafer W. The retainer ring 300 may have a flat lower surface.

The retainer ring 300 may have a desired thickness to prevent/reduce an edge rebounding phenomenon. The edge rebounding phenomenon is when an edge portion of the polishing pad 103 is concavely worn, and an edge portion of a wafer W is concavely polished due to the elasticity of the polishing pad 103. The edge rebounding phenomenon may be mitigated by pressing the polishing pad 103 with appropriate force around the edge of the wafer W using the retainer ring 300.

While not shown in the drawings, the retainer ring 300 may have a plurality of purge holes to vacuum hold the wafer W.

The retainer ring 300 may include a heat absorbing element 310, a thermoelectric element 320, and/or the heat dissipating element 330.

The heat absorbing element 310 may be brought into contact with the wafer W, the polishing pad 103, and the slurry solution 106 to reduce the temperatures thereof. The heat absorbing element 310 may absorb heat generated due to friction between the polishing pad 103 and the retainer ring 300, between the retainer ring 300 and the side surface of the wafer W, and/or between the lower surface of the wafer W and the polishing pad 103 during the polishing process on the wafer W.

The heat absorbing element 310 may be formed of ceramic. If the heat absorbing element 310 is formed of ceramic, abrasion resistance of the heat absorbing element 310 may be improved, and heat transfer may be promoted. The heat absorbing element 310 may be formed to be in direct contact with the side surface of the wafer W, the polishing pad 103, and/or the slurry solution 106.

The heat absorbing element 310 may be formed in a ring-shape. Therefore, because the heat absorbing element 310 may be disposed over the entire lower surface of the retainer ring 300, the heat generated from the edge portion of the wafer W may be efficiently absorbed.

Temperature of portions of the polishing pad 103 adjacent to the edge of the wafer W, and the slurry solution 106 may be decreased by the presence of the heat absorbing element 310. Therefore, it may be possible to reduce and/or prevent erosion and/or dishing phenomena and a non-uniform surface polishing rate.

The thermoelectric element 320 may transfer the heat absorbed by the heat absorbing element 310 to the heat dissipating element 330. The thermoelectric element 320 may be formed on the heat absorbing element 310, and may have a ring-shape, similar to the heat absorbing element 310.

The thermoelectric element 320 may control the temperature depending upon a power supply level. When power is supplied to the thermoelectric element 320, the thermoelectric element 320 may be more rapidly cooled. The thermoelectric element 320 may be a solid-state device producing lower noise and low vibration. Also, the thermoelectric element 320 may also be used for local cooling. Further, the thermoelectric element 320 may be manufactured to have a smaller size and/or lighter weight. Moreover, the thermoelectric element 320 may operate at any position and/or any direction.

Accordingly, in example embodiments, the temperature, for example, excess heat, generated during a chemical mechanical polishing process may be controlled using the thermoelectric element 320.

The heat absorbed by the heat absorbing element 310 may be transferred to the heat dissipating element 330 by way of the thermoelectric element 320. The heat dissipating element 330 may be formed on the thermoelectric element 320. The heat dissipating element 330 may be formed of ceramic. The heat absorbing element 310 and the thermoelectric element 320 may also be formed of ceramic. A locking element (not shown) to connect the retainer ring 300 to the wafer carrier 210 may be disposed on the upper end of the heat dissipating element 330.

The retainer ring 300 of the chemical mechanical polishing apparatus in accordance with the example embodiment will be described in more detail with reference to FIGS. 2A through 2F.

Referring to FIGS. 2A through 2F, the retainer ring 300 may include the heat absorbing element 310, the thermoelectric element 320, and/or the heat dissipating element 330. The thermoelectric element 320 may include an insulator 321, electrodes, and/or thermoelectric semiconductors. The thermoelectric semiconductors may include a first P-type pellet 324, a second P-type pellet 328, a first N-type pellet 325, and/or a second N-type pellet 327. The electrodes may include a first lower electrode 322, a second lower electrode 323, an upper electrode 326, and/or a power electrode 329.

Grooves 311 may be defined on a first surface of the heat absorbing element 310. A slurry solution 106 may freely discharge to the outside through the grooves 311 during the polishing. Accordingly, the first surface of the heat absorbing element 310 may be constructed of a separate ceramic plate.

The insulator 321 may be formed around the thermoelectric semiconductors to insulate the thermoelectric semiconductors. The insulator 321 may also serve as heat insulation material between the heat absorbing element 310 and the heat dissipating element 330.

The electrodes may electrically connect the thermoelectric semiconductors in series. The first lower electrode 322 and the second lower electrode 323 may be positioned on a first portion of the thermoelectric semiconductors, and the upper electrode 326 may be positioned on a second portion of the thermoelectric semiconductors. The power electrode 329 may supply power to the thermoelectric semiconductors.

The thermoelectric semiconductors may transfer the heat, absorbed by the heat absorbing element 310, to the heat dissipating element 330. The thermoelectric semiconductors may include the plurality of pellets 324, 325, 327, 328, which may be formed of a column-shape. The thermoelectric semiconductors may be composed of the P-type pellets

324, 328, and the N-type pellets 325, 327. The P-type pellets 324, 328 and the N-type pellets 325, 327 may be alternately connected with each other by the upper electrode 326. The P-type pellets 324, 328 may be formed of $Bi_xTe_ySe_z$, and the N-type pellets 325, 327 may be formed of $Bi_xTe_ySb_z$.

If a positive potential difference is applied to the first P-type pellet 324, which may be positioned between the first lower electrode 322 and the upper electrode 326, holes in the first lower electrode 322 may migrate to the upper electrode 326. The migration of the holes may transfer heat away from the first lower electrode 322.

Also, if a positive potential difference is applied to the first N-type pellet 325, which may be positioned between the second lower electrode 323 and the upper electrode 326, electrons in the second lower electrode 323 may migrate to the upper electrode 326. The migration of electrons may transfer heat away from the second lower electrode 323. Accordingly, the temperature of the heat absorbing element 310 may decrease, and the temperature of the heat dissipating element 330 may increase.

The first P-type pellet 324 and the first N-type pellet 325 may be disposed to be parallel to each other. By connecting the respective upper portions of the first P-type pellet 324 and the first N-type pellet 325 to the upper electrode 326, electrical connections may be formed in series. The lower portion of the second P-type pellet 328 may be connected in series with the lower portion of the first N-type pellet 325 through the second lower electrode 323, and the lower portion of the second N-type pellet 327 may be connected in series with the lower portion of the first P-type pellet 324 through the first lower electrode 322.

Although FIGS. 2A–2F illustrate that the thermoelectric semiconductors may be arranged in two circular loops electrically connected in series, it is understood by a person of ordinary skill that the thermoelectric semiconductors may be arranged in a single circular loop or multiple circular loops electrically connected in series. Also, the overall thermoelectric semiconductors may not necessarily be connected in series in one circular loop, but instead, may form several loops such that the thermoelectric semiconductors in each loop are connected in series and the loops are connected in parallel.

Figure 3:
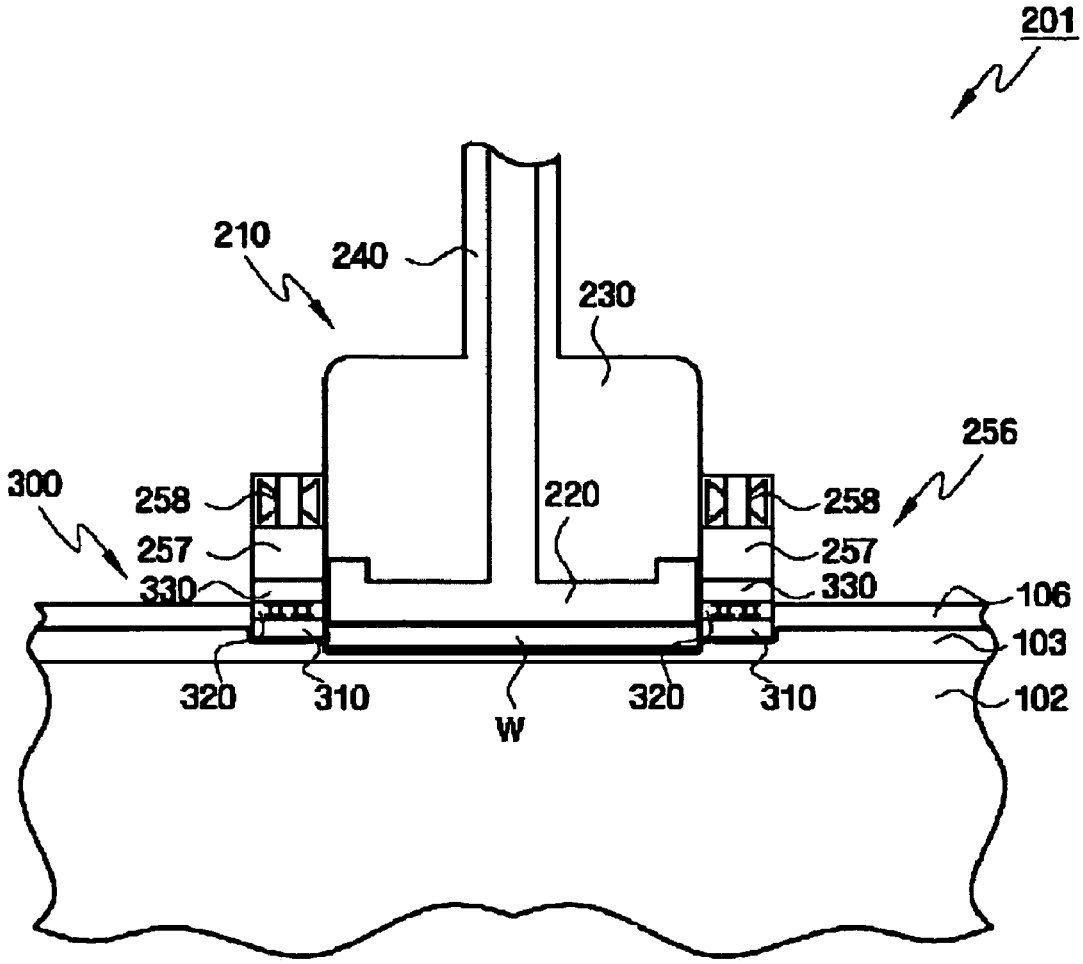
FIG. 3 is an example of longitudinal cross-sectional view illustrating a polishing head in a chemical mechanical polishing apparatus in accordance with another example embodiment of the present invention.

A chemical mechanical polishing apparatus in accordance with another example embodiment will be described with reference to FIG. 3. FIG. 3 is a longitudinal cross-sectional view illustrating a polishing head in a chemical mechanical polishing apparatus in accordance with another example embodiment.

Figure 2A:
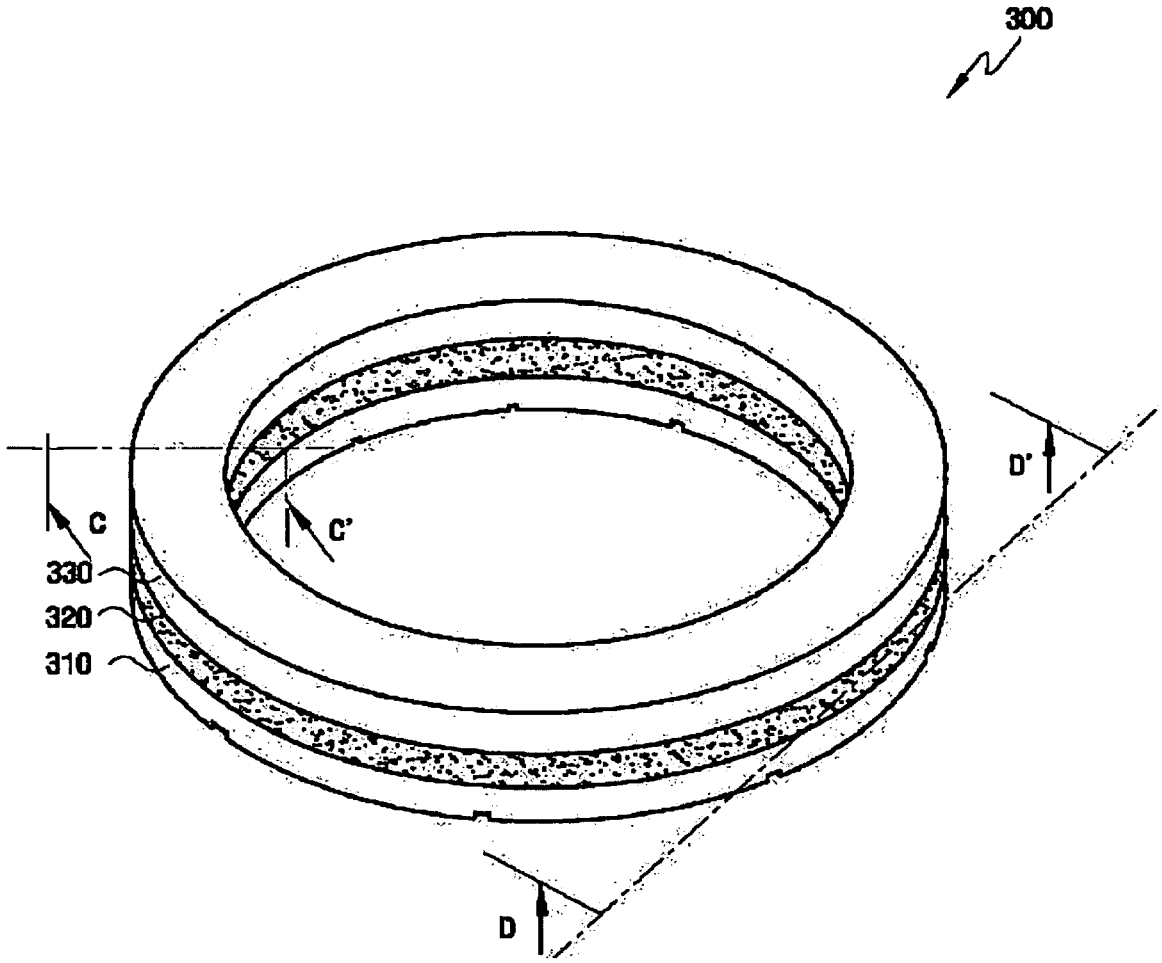
FIG. 2A is a perspective view illustrating a retainer ring in a chemical mechanical polishing apparatus in accordance with an example embodiment.
Figure 2B:
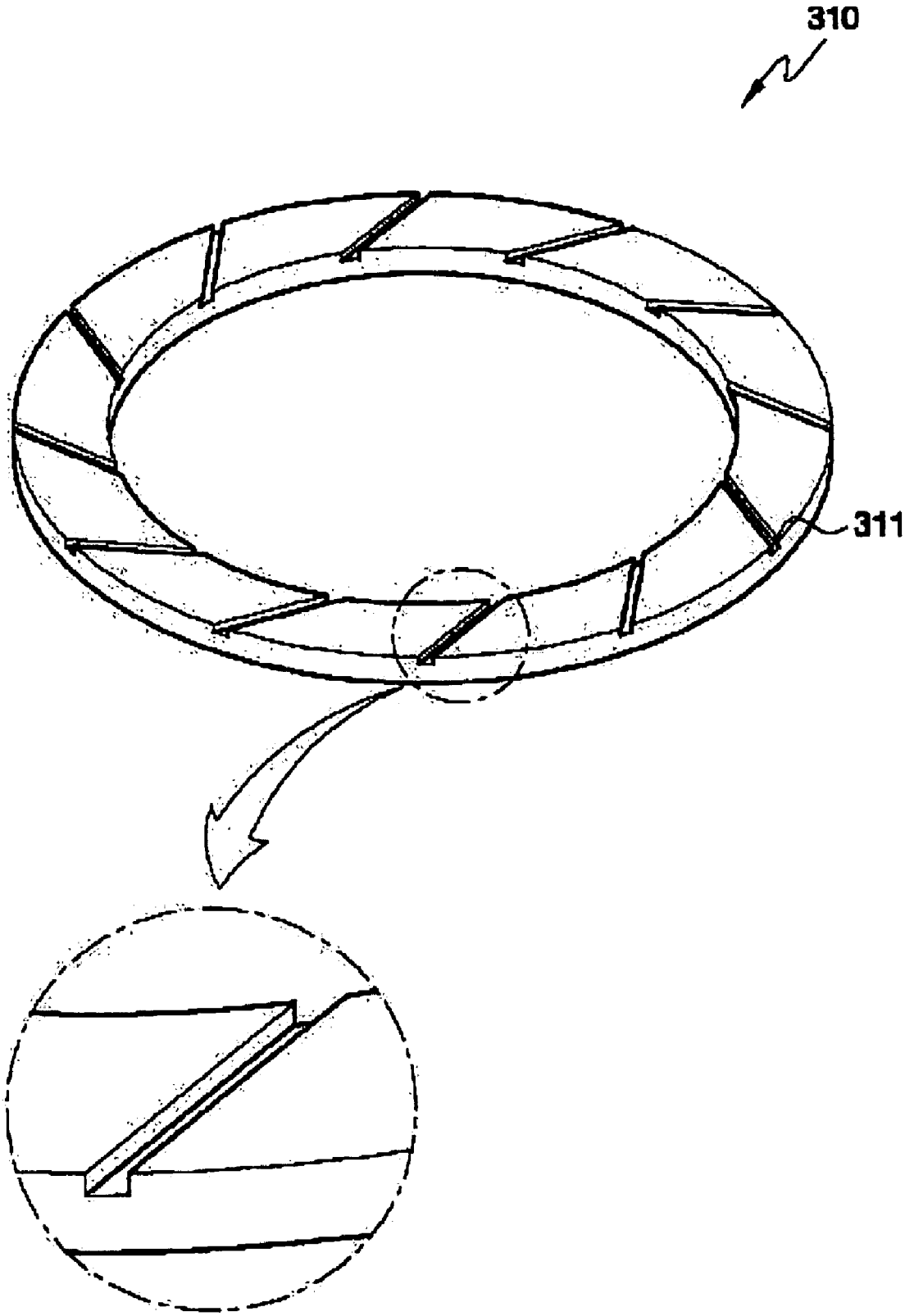
FIG. 2B is an example of partially enlarged perspective view illustrating the lower surface of the heat absorbing element of the retainer ring.
Figure 2C:
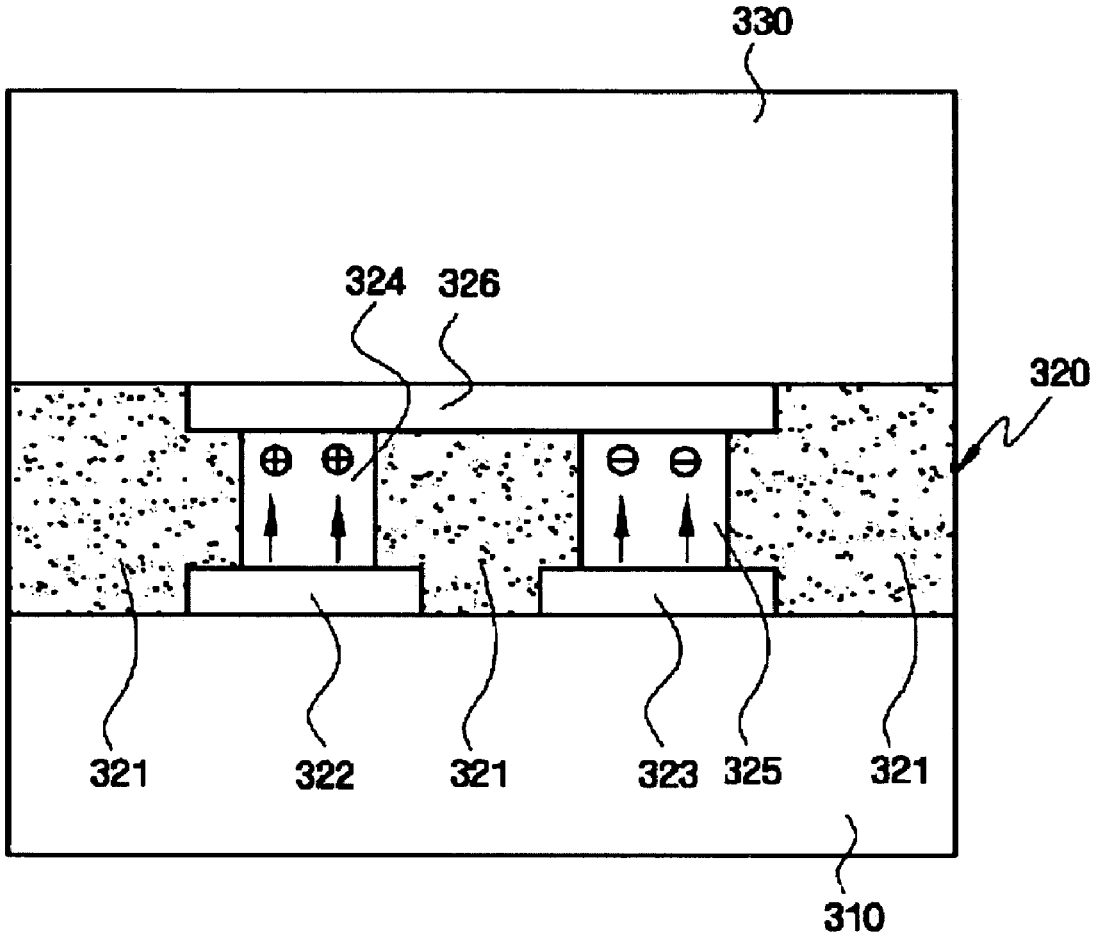
FIG. 2C is an example of longitudinal cross-sectional view of the retainer ring, taken along the line C–C' of FIG. 2A.
Figure 2D:
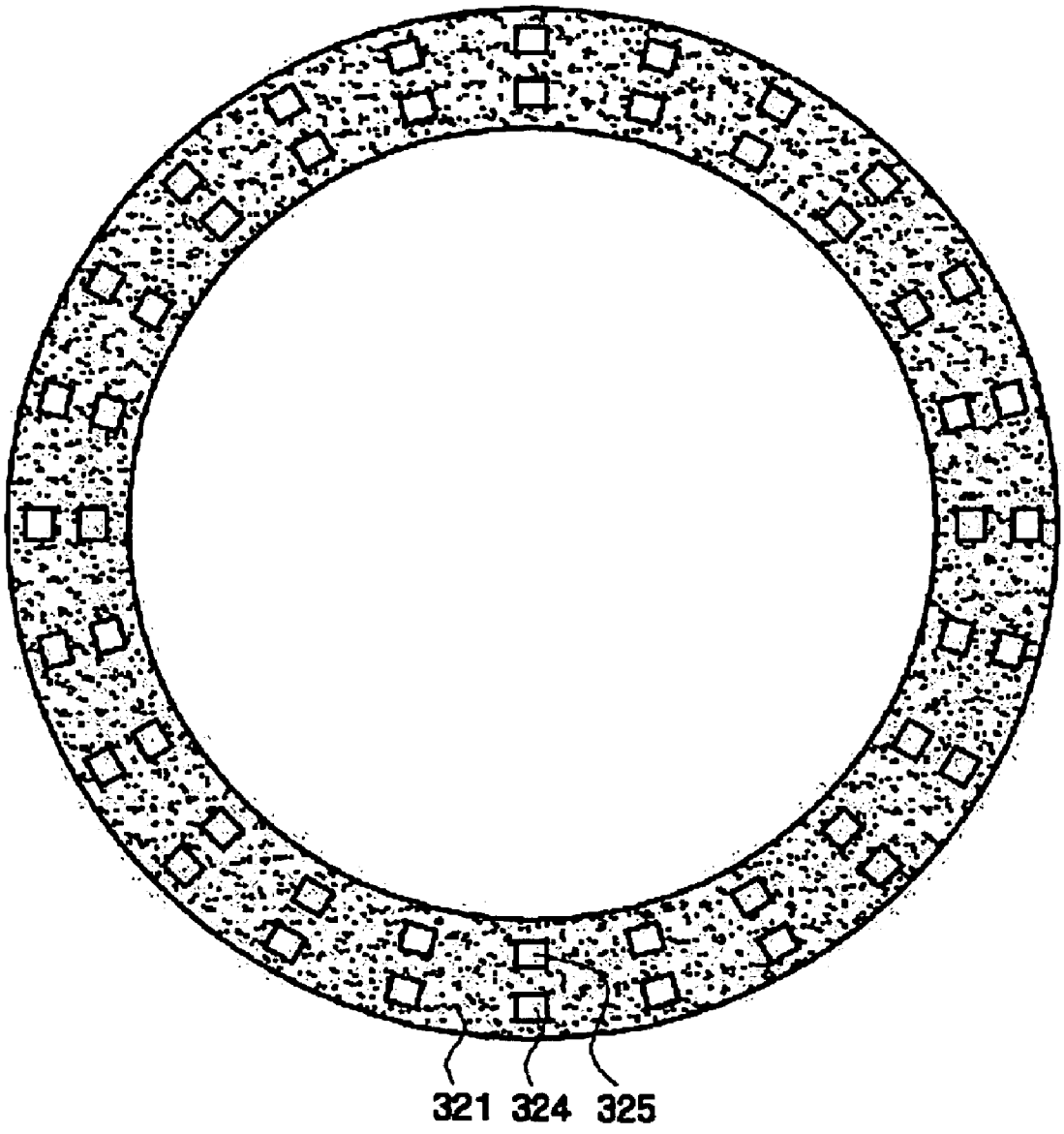
FIG. 2D is an example of transverse cross-sectional view of the retainer ring, taken along the line D–D' of FIG. 2A.
Figure 2E:
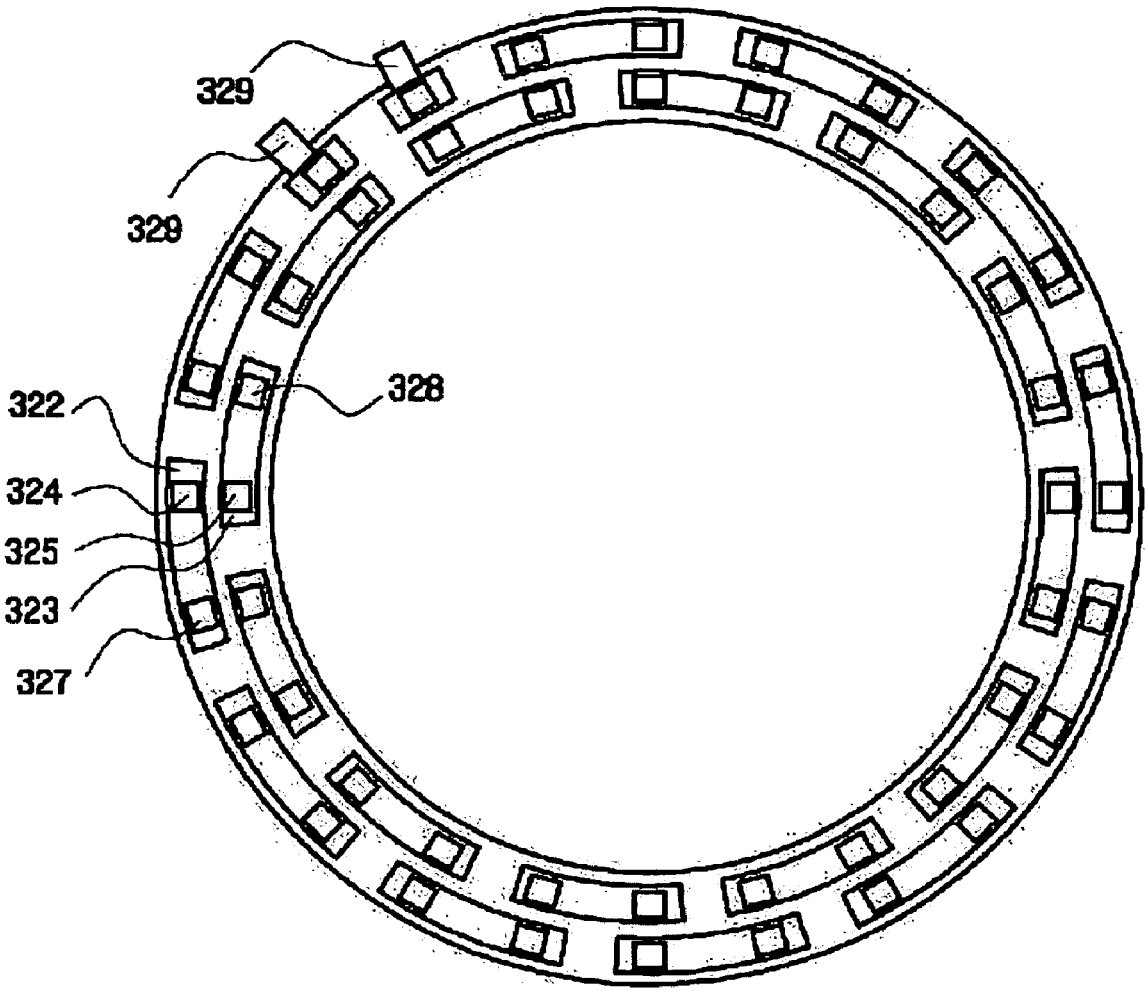
FIG. 2E is an example of plan view illustrating a stacked heat absorbing element, lower electrodes and thermoelectric semiconductors.
Figure 2F:
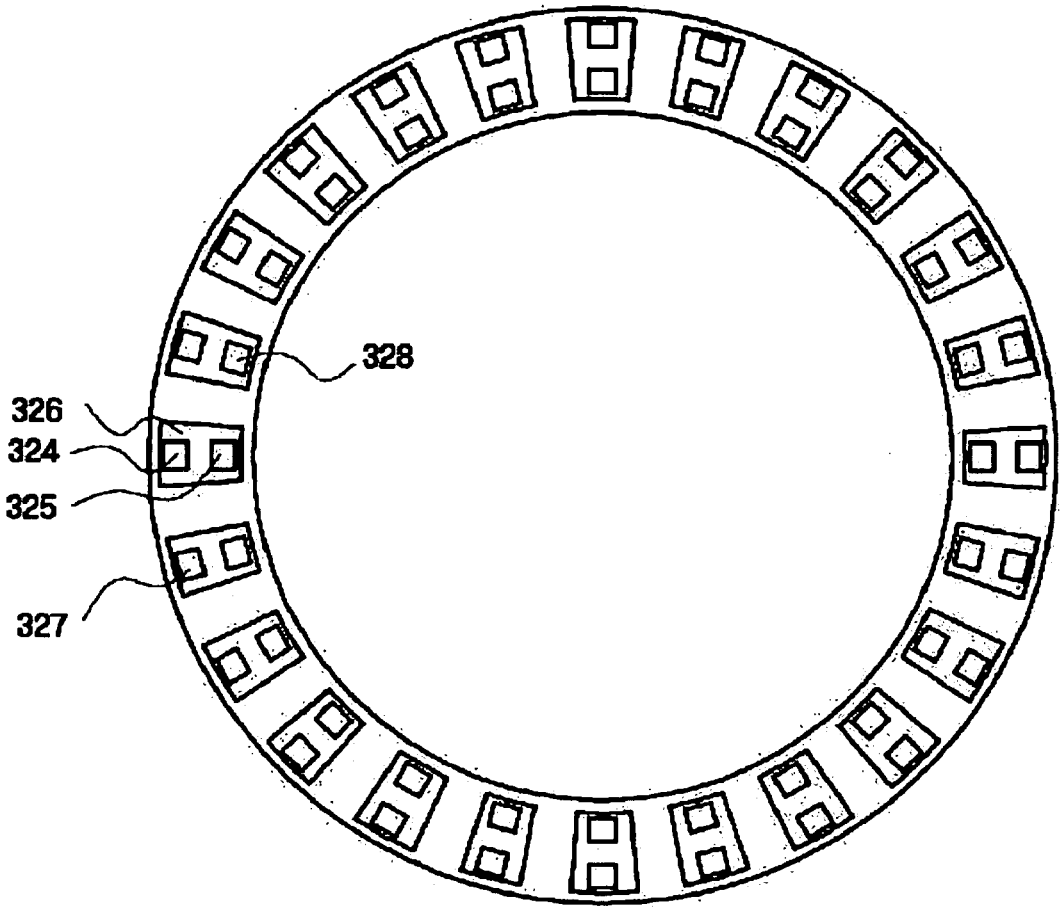
FIG. 2F is an example of bottom view illustrating a stacked thermoelectric semiconductors, upper electrodes, and a heat dissipating element.

Referring to FIG. 3, the polishing head 201 in accordance with another example embodiment of the present invention is different from the polishing head 200 illustrated in FIGS. 1–2F in terms of the construction of the cooling element. The polishing head 201 may include an air cooling-type cooling device 256 as the cooling element.

The air cooling-type cooling device 256 may include a heat radiating plate 257 and a cooling fan 258. The heat radiating plate 257 may be disposed to be in contact with a heat dissipating element 330 of a retainer ring 300. The cooling fan 258 may be positioned on the heat radiating plate 257.

A retainer ring in accordance with another example embodiment of the present invention will be described below with reference to FIG. 4.

Figure 4:
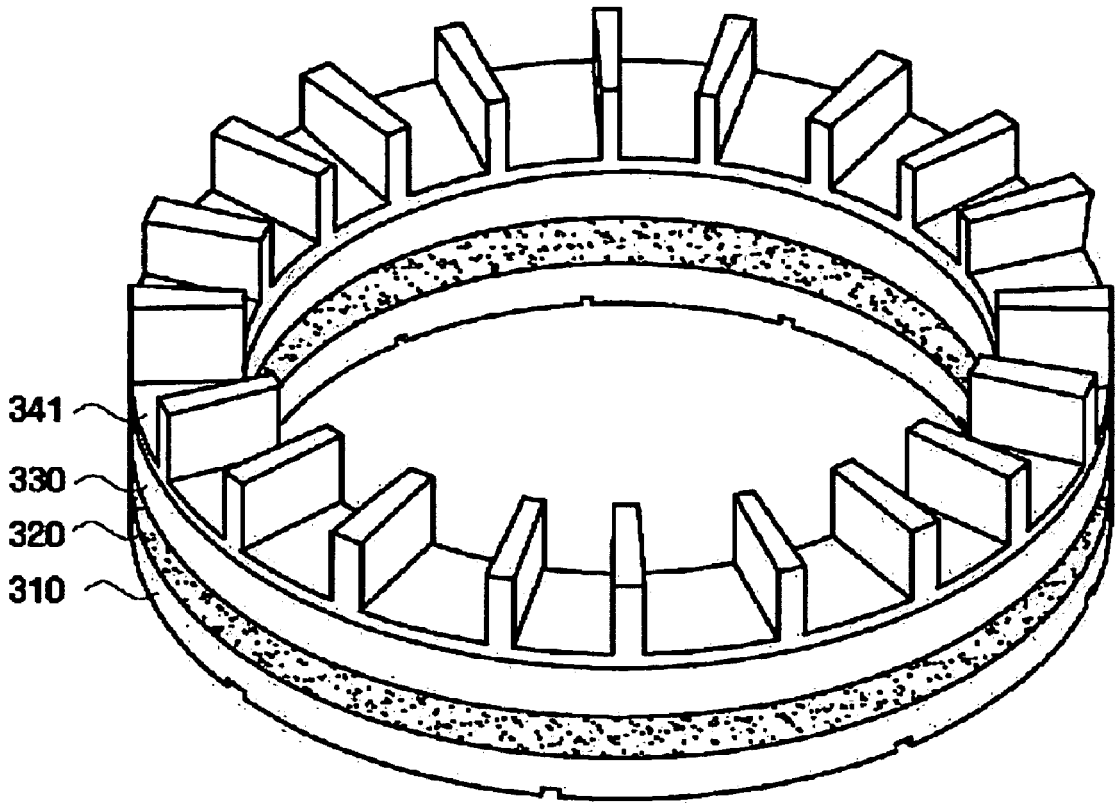
FIG. 4 is a perspective view illustrating a retainer ring in accordance with another example embodiment.

Referring to FIG. 4, the retainer ring in accordance with another example embodiment may include a heat radiating plate 341 as a cooling element for lowering the temperature of a heat dissipating element 330. The heat radiating plate 341 may be brought into direct contact with the heat dissipating element 330. In order to increase the air contact area of the heat radiating plate 341, a plurality of fins 345 extending upward may be formed on the heat radiating plate 341. A cooling fan (not shown) may be located on the plurality of fins 345. The cooling element may be formed on a retainer ring rather than on a polishing head.

A retainer ring in accordance with another example embodiment will be described below with reference to FIG. 5.

Figure 5:
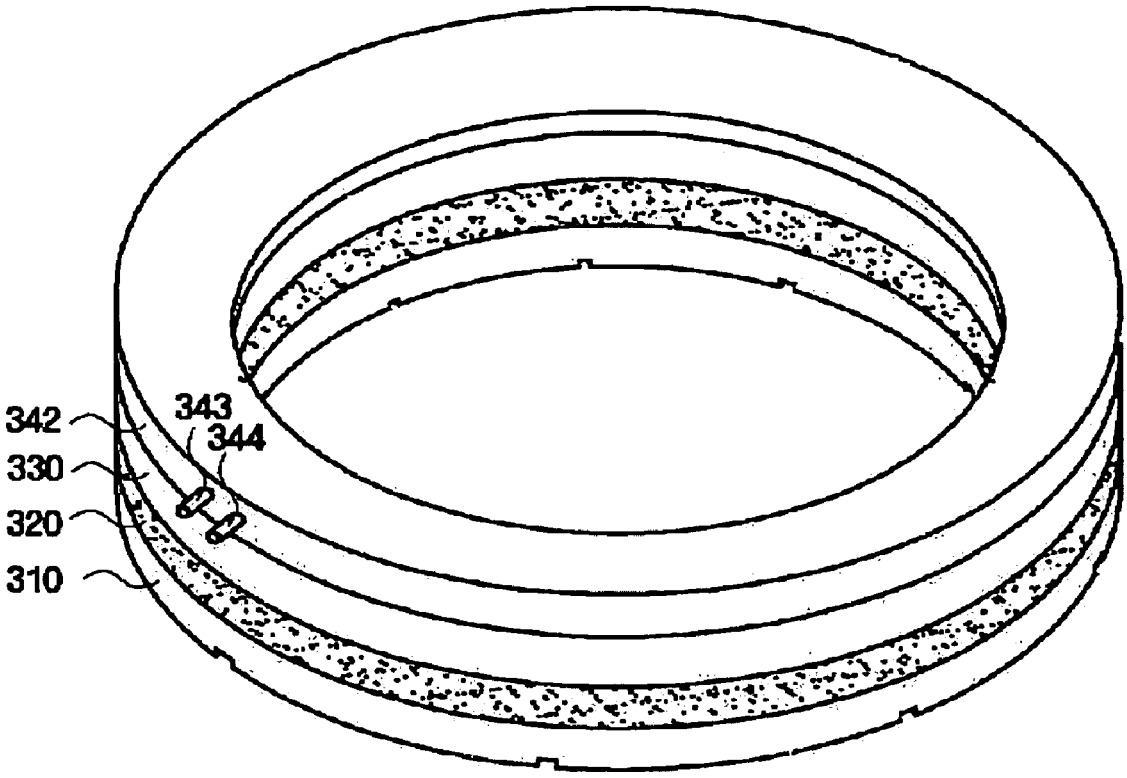
FIG. 5 is a perspective view illustrating a retainer ring in accordance with still another example embodiment.

Referring to FIG. 5, a water jacket 342 may be disposed on a heat dissipating element 330. The water jacket 342 may have a cooling water inlet port 343 and a cooling water outlet port 344. Components (not shown) constituting the water cooling-type cooling device may be disposed outside the retainer ring. For example, a temperature adjustor, a radiator, a water tank, and/or a water pump may be located on the polishing head.

In the case that the cooling element does not operate properly, a heat absorbing element 310 may over heat a heat dissipating element 330. Accordingly, if the cooling element is not properly operating, it may be necessary to inform operators of the current situation by means of an alarm sound, flashing light, etc. Accordingly, a control section may be configured to monitor whether the cooling element is properly operating.

Figure 6A:
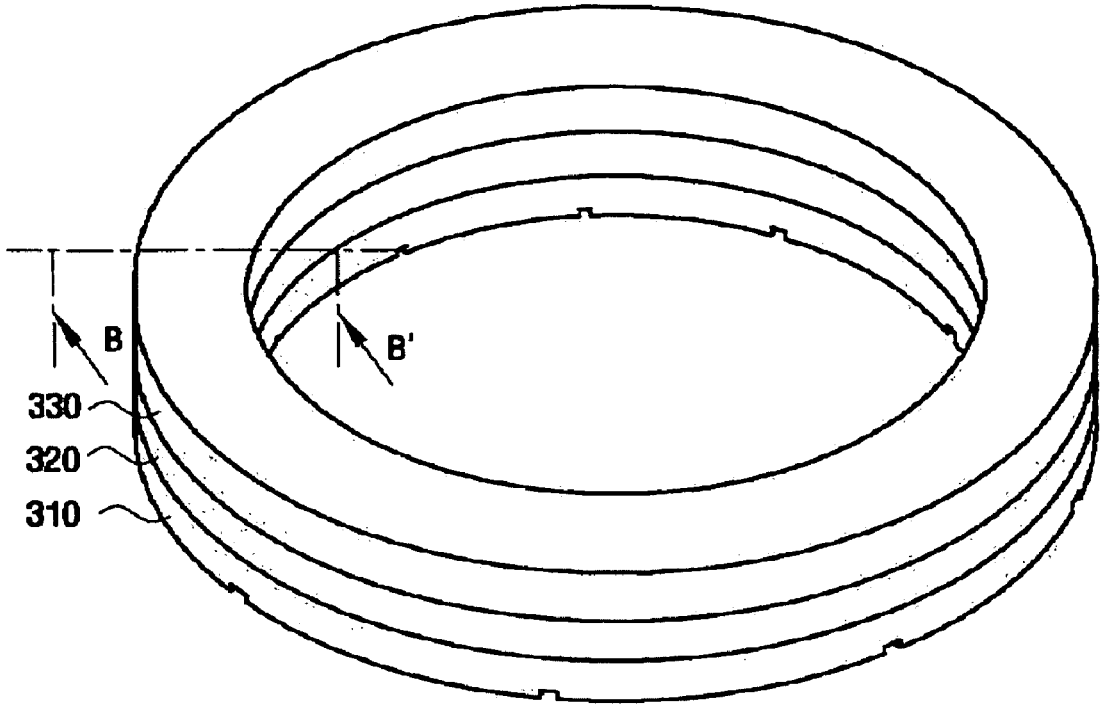
FIG. 6A is a perspective view illustrating a retainer ring in accordance with a yet another example embodiment.
Figure 6B:
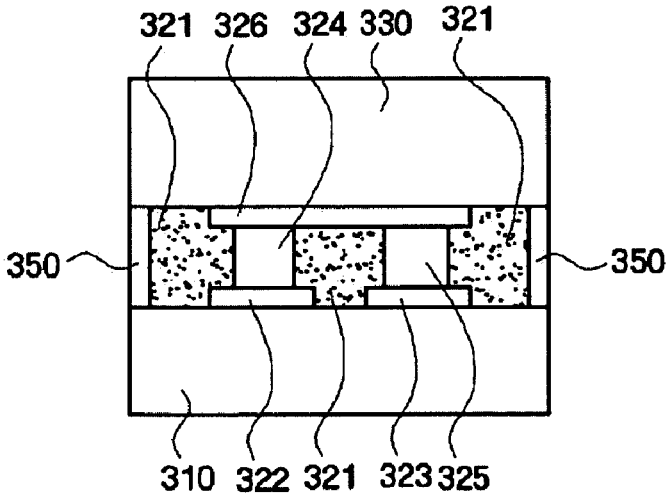
FIG. 6B is an example of longitudinal cross-sectional view taken along the line B–B' of FIG. 6A.

A retainer ring in accordance with a still another example embodiment of the present invention will be described below with reference to FIGS. 6A and 6B.

The retainer ring in accordance with still another example embodiment of the present invention may include thermoelectric element protection layers 350. A thermoelectric element protection layer 350 may be formed of polyurethane to prevent/reduce an insulator 321, a first lower electrode 322, a second lower electrode 323, an upper electrode 326, a first P-type pellet 324, and a first N-type pellet 325 from corrosion.

Figure 7:
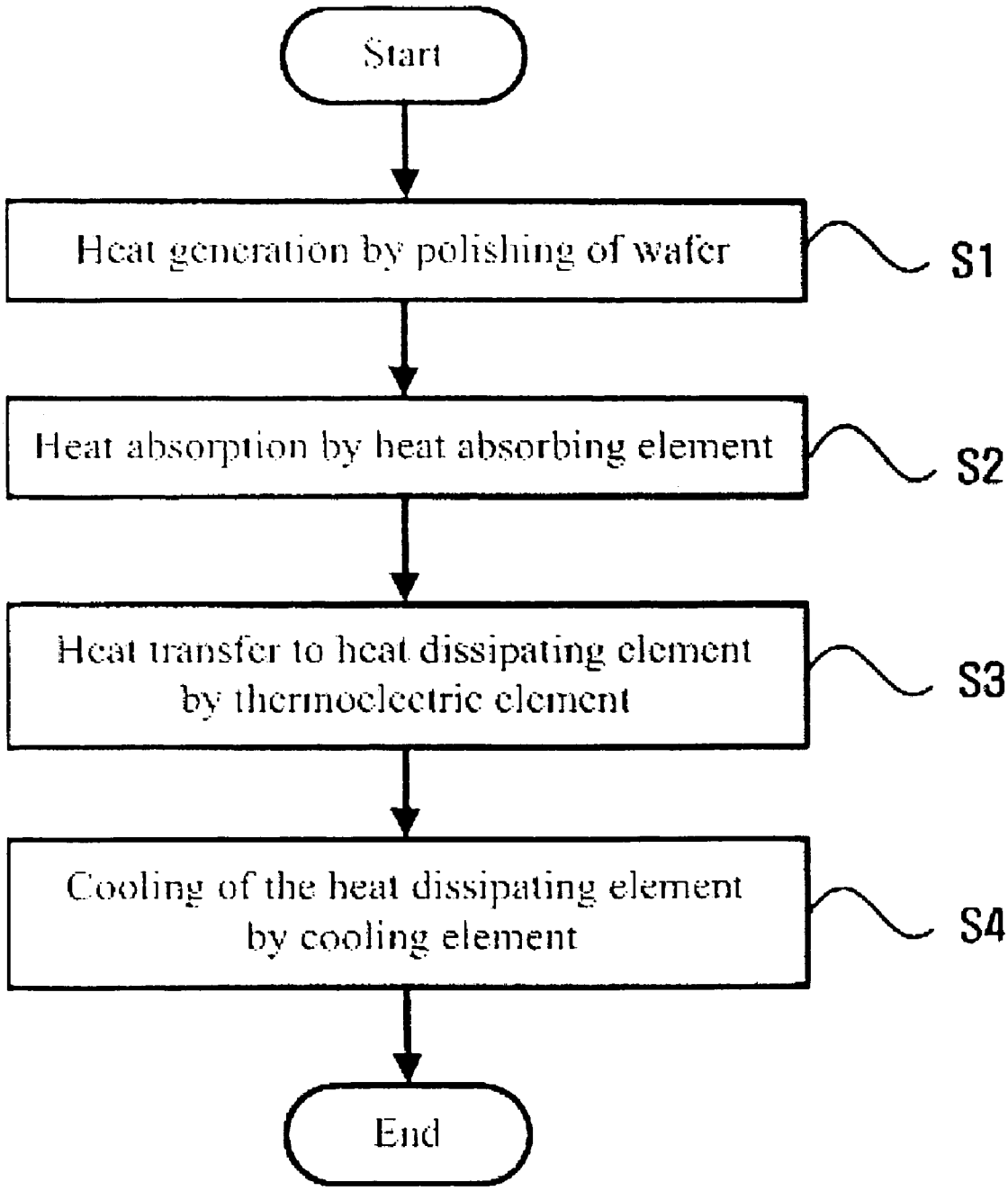
FIG. 7 is an example of flow chart illustrating the operation of the chemical mechanical polishing apparatus according to example embodiments.

FIG. 7 is a flow chart illustrating an operation of a chemical mechanical polishing apparatus according to example embodiments of the present invention.

Referring to FIG. 7, a wafer held by a wafer carrier by vacuum may be polished by a polishing pad and slurry solution. During the polishing process, heat may be generated due to friction between the wafer and a retainer ring, between the retainer ring and the polishing pad, and between the polishing pad and the wafer (S1). Protecting layers may absorb the heat generated during the polishing process (S2). The heat absorbed by the heat absorbing element may be transferred to a heat dissipating element by the thermoelectric element (S3). A cooling element may cool the heat dissipating element (S4).

A retainer ring having a thermoelectric element may directly cool a polishing pad and a wafer, therefore, heat generated during the CMP process may be continually cooled. Accordingly, the temperature of the CMP process may be appropriately maintained, erosion and dishing phenomena occurring around the edge portion of the wafer may be reduced.

Temperatures of a polishing pad, an edge of a wafer, and slurry may be quickly reduced, and it may be possible to prevent/reduce the erosion and dishing of the edge portion of the wafer, and to prevent/reduce a non-uniform surface polishing rate due to the thermoelectric element provided to a retainer ring.

A cooling element may be disposed on a heat dissipating element of a retainer ring to effectively cool the heat dissipating element of the retainer ring.

Grooves may be defined on a first surface of a heat absorbing element of the retainer ring so that slurry solution may be more easily discharged.

The heat absorbing element of the retainer ring may be formed of ceramic to reduce or minimize abrasion of the heat absorbing element.

A cooling element may be arranged in the polishing head to reduce or minimize the size of the retainer ring.

Protective cover layers may be formed on sides of a thermoelectric element to reduce/prevent corrosion of the thermoelectric element.

Although example embodiments have been described, those skilled in the art will appreciate that various modifications, additions and substitutions are possible, without limiting the scope of example embodiments, as disclosed in the accompanying claims.

What is claimed is:

1. A retainer ring comprising:

a heat absorbing element retaining a wafer therein;

a thermoelectric element formed on the heat absorbing element; and a heat dissipating element positioned on the thermoelectric element to dissipate heat absorbed by the heat absorbing element.

2. The retainer ring according to claim 1, wherein the thermoelectric element includes thermoelectric semiconductors which have a column-shaped configuration, and are electrically connected in series with one another.

3. The retainer ring according to claim 1, wherein the heat absorbing element is formed of ceramic.

4. The retainer ring according to claim 1, wherein a lower surface of the heat absorbing element is defined with grooves.

5. The retainer ring according to claim 1, further comprising:

a cooling element provided on the heat dissipating element.

6. The retainer ring according to claim 5, wherein the cooling element includes an air cooling-type heat radiation plate.

7. The retainer ring according to claim 5, wherein the cooling element includes a water cooling-type water jacket.

8. The retainer ring according to claim 1, further comprising:

protective layers provided on surfaces of the thermoelectric element.

9. A polishing head comprising:

a wafer carrier holding and moving a wafer; and the retainer ring of claim 1, disposed on a lower end of the wafer carrier.

10. The polishing head according to claim 9, wherein the thermoelectric element includes thermoelectric semiconductors which have a column-shaped configuration and are electrically connected in series with one another.

11. The polishing head according to claim 9, wherein the heat absorbing element is formed of ceramic.

12. The polishing head according to claim 9, wherein a lower surface of the heat absorbing element is defined with grooves.

13. The polishing head according to claim 9, further comprising:

a cooling element provided on the heat dissipating element.

14. The polishing head according to claim 13, wherein the cooling element includes an air cooling-type heat radiation plate.

15. The polishing head according to claim 13, wherein the cooling element includes a water cooling-type water jacket.

16. The polishing head according to claim 9, further comprising:

protective layers provided on surfaces of the thermoelectric element.

17. The polishing head according to claim 9, wherein the wafer carrier includes a cooling element for cooling the heat dissipating element.

18. A chemical mechanical polishing apparatus comprising:

a polishing pad formed on a platen; and the polishing head of claim 9, positioned on the polishing pad.

19. The apparatus according to claim 18, wherein the thermoelectric element includes thermoelectric semiconductors which have a column-shaped configuration and are electrically connected in series with one another.

20. The apparatus according to claim 18, wherein the heat absorbing element is formed of ceramic.

21. The apparatus according to claim 18, wherein a lower surface of the heat absorbing element is defined with grooves.

22. The apparatus according to claim 18, wherein the retainer ring further includes a cooling element provided on the heat dissipating element.

23. The apparatus according to claim 22, wherein the cooling element includes an air cooling-type heat radiation plate.

24. The apparatus according to claim 22, wherein the cooling element includes a water cooling-type water jacket.

25. The apparatus according to claim 18, further comprising:

protective layers provided to surfaces of the thermoelectric element.

26. The apparatus according to claim 18, wherein the wafer carrier further includes a cooling element for cooling the heat dissipating element.

* * * * *